United States Patent [19]

Hightower

[11] Patent Number: 4,872,501

[45] Date of Patent: Oct. 10, 1989

[54] HEAT EXCHANGER FOR MOBILE AIRCRAFT DEICING MACHINE AND METHOD OF USE

[75] Inventor: Edwin C. Hightower, Orlando, Fla.

[73] Assignee: FMC Corporation, Chicago, Ill.

[21] Appl. No.: 840,356

[22] Filed: Mar. 17, 1986

[51] Int. Cl.[4] ..... B64D 15/00

[52] U.S. Cl. ..... 165/1; 165/109.1; 165/132; 244/134 C; 244/134 R; 239/135; 239/142; 239/172

[58] Field of Search ..... 165/47, 108, 109, 132, 165/1; 244/134 R, 134 C, 134 D; 237/123 R; 126/271.1; 239/135, 172, 142

[56] References Cited

U.S. PATENT DOCUMENTS

| | | | |
|---|---|---|---|
| 2,979,308 | 4/1961 | Putney | 165/108 |
| 3,243,123 | 3/1966 | Inghram et al. . | |
| 3,567,402 | 3/1971 | Christensen | 165/109.1 |
| 3,759,318 | 9/1973 | Putney et al. | 165/108 |
| 3,856,078 | 12/1974 | Dahl | 165/108 |
| 3,976,430 | 8/1976 | Houston et al. | 165/109.1 |
| 4,333,607 | 6/1982 | Mueller et al. | 239/131 |

FOREIGN PATENT DOCUMENTS

| | | | |
|---|---|---|---|
| 3026625 | 2/1982 | Fed. Rep. of Germany | 165/108 |
| 1297239 | 5/1962 | France | 165/108 |
| 2211636 | 7/1974 | France | 165/109.1 |
| 822811 | 11/1959 | United Kingdom . | |

*Primary Examiner*—Albert W. Davis, Jr.
*Assistant Examiner*—John K. Ford
*Attorney, Agent, or Firm*—Ronald C. Kamp; R. B. Megley

[57] ABSTRACT

A tank for heating deicing fluid in a mobile aircraft deicer comprises a submerged heat exchanger coil through which heating fluid passes. Propellers near the heat exchanger circulate the bulk of deicing fluid while it is being heated to help distribute the heat. Pivoting shutters isolate an area beneath the heat exchanger from the bulk of deicer fluid and from which deicing fluid is withdrawn by a pump. This allows the bulk of deicer fluid to be further heated in a "last-pass" before being discharged upon the aircraft. A method of heating deicing fluid using this apparatus is also disclosed.

7 Claims, 2 Drawing Sheets

FIG_1
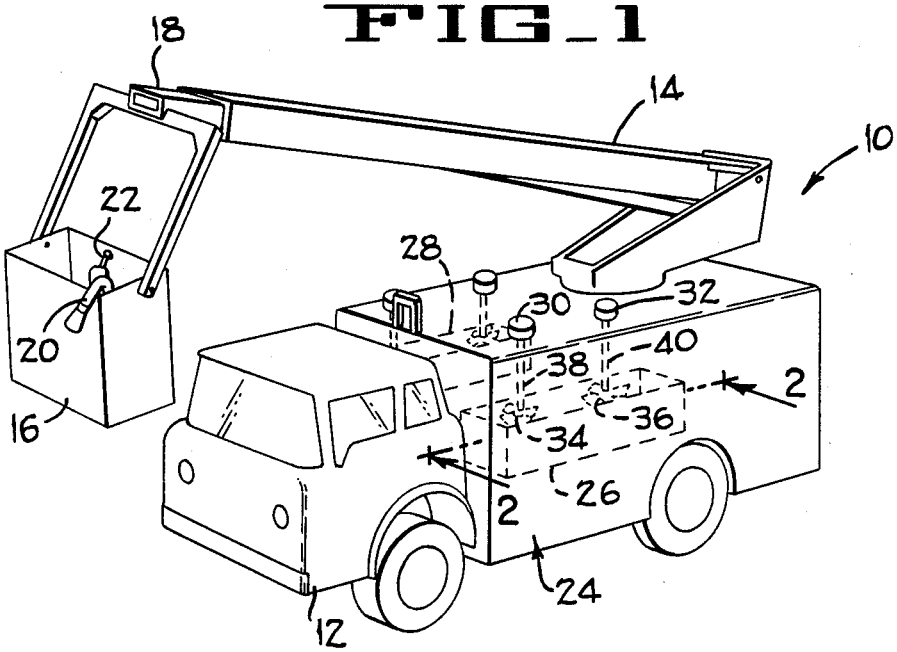
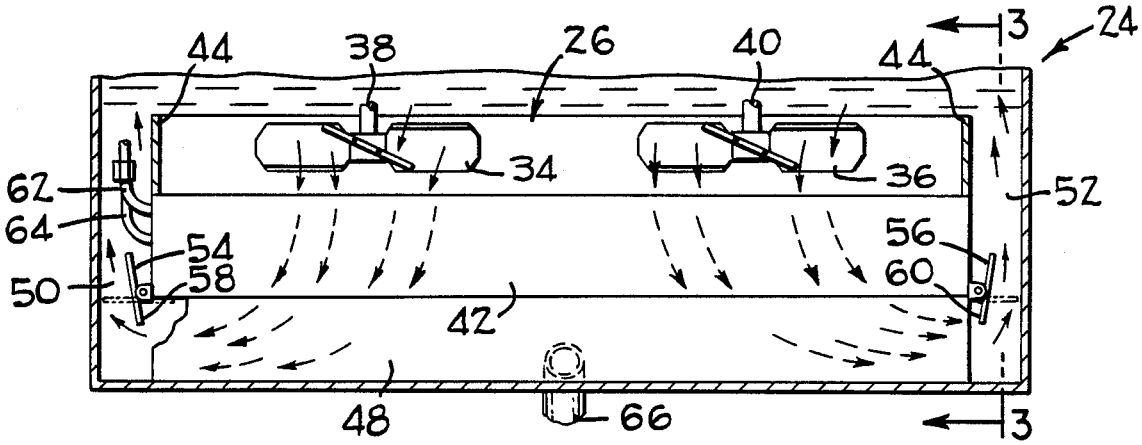
FIG_2
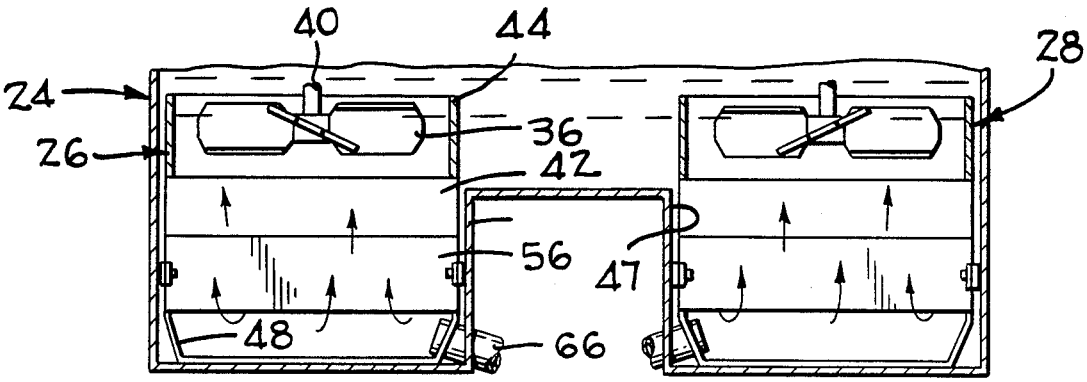
FIG_3

HEAT EXCHANGER FOR MOBILE AIRCRAFT DEICING MACHINE AND METHOD OF USE

This invention relates to heat exchangers generally, and more particularly, to heat exchangers for heating aircraft deicing fluid in mobile aircraft deicing machines.

Heat exchangers submerged in the tanks of mobile aircraft deicing machines have been used to heat thixotropic and/or pseudo-plastic fluids, such as those classified by the Association of European Airlines as Type II aircraft deicing fluid. Type II fluids are susceptible to deterioration or breakdown of those properties and attributes which are desirable for use as an aircraft deicing or anti-icing fluid when subjected to excessive pumping or exposure to high temperature surfaces, or when maintained at lower but elevated temperatures for long time periods.

The present invention provides a heat exchanger for heating aircraft deicing fluid in a tank of a mobile aircraft deicing machine which is compatible with Type II fluids but is also capable of heating other types of aircraft deicing fluids, which functions as both the bulk heater for such fluids as well as providing a "once through" or "last pass" heating; which affords a relatively short heat-up time for the deicing fluid, and which is relatively simple to construct, operate and maintain. These and other attributes of the present invention, and many of its attendant advantages, will become more readily apparent from a perusal of the following description when considered in connection with the accompanying drawings, wherein:

FIG. 1 is a pictorial representation of a mobile aircraft deicing machine incorporating heat exchangers according to the present invention;

FIG. 2 is a fore and aft, vertical cross-sectional view of one of the heat exchangers taken on line 2—2 of FIG. 1;

FIG. 3 is a cross-sectional view taken on line 3—3 of FIG. 2;

Figure 4:
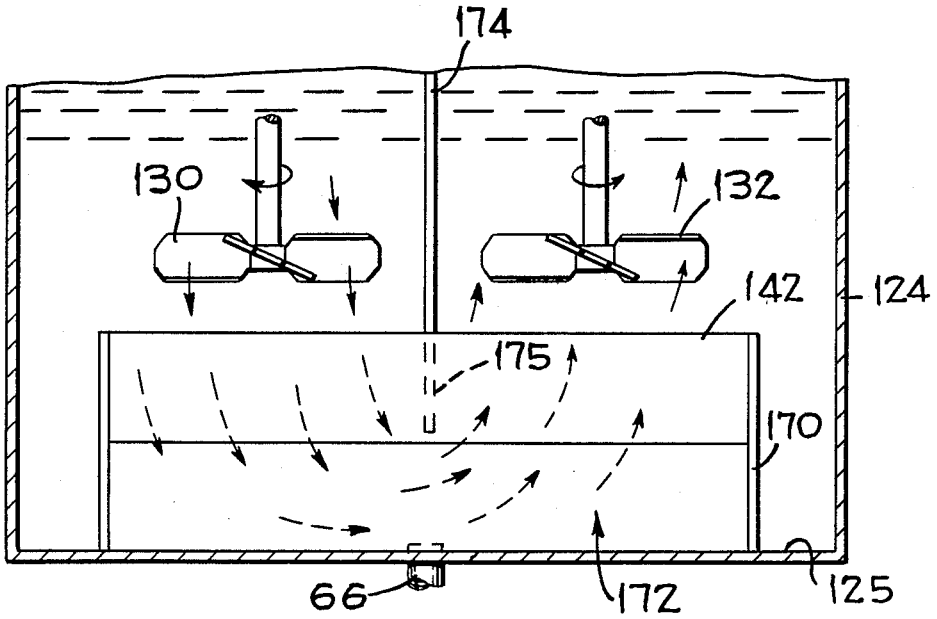
FIG. 4 is a vertical cross-sectional view, similar to FIG. 2, of another embodiment of the present invention.

Referring to FIG. 1, a mobile aircraft deicing machine (commonly referred to as simply a deicer), indicated generally at 10, includes a wheeled chassis 12 on which a boom 14 is mounted. An operator basket 16 is suspended from the end 18 of the boom. The boom may be rotated about a vertical axis, and the end 18 of the boom suspending the basket 16 may be raised and lowered as well as extended and retracted, all of which is conventional, which permits positioning the basket at a variety of selected positions relative to the aircraft being deiced to facilitate effective application of the deicing fluid to the various surfaces of the aircraft. Controls, such as indicated at 22, are provided to permit an operator in the basket 16 to manipulate the boom 14. Spray gun equipment, such as shown at 20, is provided in the basket for use by the operator in distributing the deicing fluid which is pumped from the tank 24 through appropriate conduits, in part running beside or on the interior of the boom 14, to the spray gun equipment 20.

For simplicity, the deicer 10 is shown with one fluid tank 24 in which two heat exchangers 26 and 28 are mounted, but the heat exchangers may be mounted in individual tanks, if desired. The two heat exchangers 26 and 28 are essentially identical, so a description of only one is sufficient for a complete understanding of the invention. A pair of motors 30 and 32, which may be either electric or rotary hydraulic, are attached to the top of the tank 24 and have propellers 34 and 36 secured to the end of the respective output shafts 38 and 40 of the motors 30 and 32. As shown in FIGS. 2 and 3, the propellers 34 and 36 are positioned above a coil element 42, which may have a finned tube construction similar to a conventional automobile radiator. A shroud 44 is secured around the upper periphery of the coil element 42 and extends to a elevation above the propellers 34 and 36. The tank 24 preferrable has a "saddle" configuration, i.e., formed with two fore and aft extending depressions or pockets, one of which is shown at 46 and the other at 47, with a coil element positioned in each pocket, as best shown in FIG. 3. A support 48, which is essentially U-shaped in cross-section and open at the front and rear, is secured to the coil element 42 and rests on the bottom of the pocket 46 to support the coil element 42 and its attached shroud 44. The transverse width of the coil element 42 is substantially the same as the transverse width of the pocket 46, but has a fore and aft length which is less than the similar dimension of the pocket 46 forming passages 50 and 52 at the front and rear respectfully of the coil element. A pair of flappers 54 and 56 are pivotably mounted on the coil member 42 and extend along the front and rear lower edges respectively of the coil member 42. The front flapper 54 when pivoted to the dotted line position effectively closes the passage 50 and similarly the rear flapper 56 closes passage 52. Stop tabs 58 and 60 are formed on the flappers 54 and 56 respectively and limit the rotation of the flappers to about 90 degrees by engaging the under side of the coil element 42, as shown by the dotted line position of the flapper 54 in FIG. 2.

An intake or suction line 66, which connects with the inlet of a pump, not shown, extends through the sidewall of the pocket 46 and has its open end positioned below the coil element 42 and preferably centered along the fore and aft length thereof. This pump supplies deicer fluid to the spray gun equipment 20 in the basket 16 for application of the deicing fluid. The coil element 42 includes tubes 62 and 64 to permit circulation of a hot fluid through the coil element. The hot fluid may be a gas, such as steam, for example, or a liquid, such as water, anti-freeze solution, hydraulic oil or torque converter or transmission fluid, for example.

In the bulk heating mode, with the tank 42 initially filled with a cold deicing fluid, the motors 30 and 32 are turned on causing the propellers 34 and 36 to rotate. The pitch of the propeller blades and their direction of rotation are such that the deicing fluid flows downward through the coil element 42, as indicated by the flow lines in FIG. 2. The slight pressure differential created by this flow causes the flappers 54 and 56 to pivot upward, as shown in FIG. 2, and the deicer fluid flows upward through the passages 50 and 52 at each end of the coil element 42. Heat in the hot fluid circulating through the tubes of the coil element 42 is transferred to the deicing fluid as it flows downward between and in contact with the exterior surfaces of the tubes in the coil element 42. The heated deicer fluid then flows upward through the passages 50 and 52 where it mixes with colder deicer fluid within the tank 24. The shroud 44 assures a more thorough mixing action. As this process continues, the temperature of all of the fluid in the tank 24 will be raised. The propellers 34 and 36 function to stir, rather than pump, the deicing fluid, and hence, impose only moderate shear forces on the deicing fluid, with any incremental portion of the deicing fluid being subjected to such forces only during relatively short spans of time. The coils of element 42 present a large surface area for transfer of heat with the temperature of that surface relatively low; below the temperature at which damage to Type II fluids would occur. As a consequence, Type II fluids may be heated without any appreciable deterioration of their properties. Stirring means other than propellers may be employed as long as the shear forces they exert on the deicing fluid are relatively low and intermittent. In the pumping or spraying mode, the motors 34 and 36 are turned off so that the propellers 38 and 40 are not driven and the aforementioned pump for drawing the heated deicing fluid from the tank 24 is started. The heated deicing fluid is drawn through the open end of suction line 66 which creates a lower pressure below the coil element. This lower pressure, coupled with an initial reverse or downward flow through the passages will cause the flappers 54 and 56 to rotate to their closed position, as indicated by dotted lines in FIG. 2, in which the passages 50 and 52 are blocked. The isolated deicing fluid immediately below the coil element 42 will have a higher temperature than the bulk of the deicing fluid in the tank 24, because it has not yet mixed with the colder fluid in the tank and because the time the fluid is in contact with the coil element 42 is longer, permitting more heat to be transferred to each incremental portion of deicing fluid passing therethrough; the flow now determined solely by the rate at which deicing fluid is pumped through pipe 66 and expelled from the apparatus 20 being slower than the rate of flow determined by the propellers. Thus, in the pumping mode, the deicing fluid directed to the spraying apparatus 20 will have a temperature appreciably higher than the bulk of the deicing fluid in tank 24. The same heat exchanger, therefore, provides bulk heating of the deicing fluid as well as providing "last pass" heating for the fluid. The bulk of the deicing fluid may be heated to, and maintained at, a lower holding temperature, which minimizes evaporation losses and, with Type II fluids minimizes deterioration and the temperature thereof raised to a more effective deicing temperature just prior to applying the deicing fluid to the aircraft.

The embodiment shown in FIG. 4 may be used with a tank 124 of any convenient configuration. The coil element 142, which may be similar to element 42, is enclosed on all vertical sides and supported by enclosure member 170, which rests on the floor 125 of the tank 124. The member 170 positions the coil element 142 above the floor 125 to form an enclosed space 172 between the floor 125 and the coil element 142. A pair of driven propellers 130 and 132 are positioned above the coil element 142, with propeller 130 having a pitch and direction of rotation to force deicing fluid downward and propeller 132 arranged and driven to draw fluid upward, as indicated by the solid flow lines. A divider panel 174, is retained within the tank 124 and is positioned between the two propellers 130 and 132, but does not extend fully across the tank 124, or if it does, which may be advantageous as a baffle to dampen fluid movement within the tank during transport, then openings must be provided along the edges near the tank walls to permit a thorough mixing and movement of the fluid from one side to the other. The pump suction pipe 66 extends through the floor 125 with its open end within the enclosed space 172. Bulk heating of the deicing fluid is achieved by driving both propellers to cause fluid to flow downward through the coil element 142 into the space 172 and then upward through the coil element 142, as shown by the flow lines. The fluid is thereby passed over the heated coils within the coil element twice, before it mixes with the cold fluid in the tank. If the coil element 142 is of tube type, i.e., without fins on the tubes, it is desirable to include a divider element 175 within the coil unit to assure that the flow pattern of the fluid through the coil element 142 is as indicated in FIG. 4. During pumping mode, the propellers are not driven and the fluid is drawn out of the space 172 through the open end of suction pipe 66. Again, the temperature of the deicing fluid being pumped is higher than the temperature of the bulk fluid within the tank 124.

Figure 5:
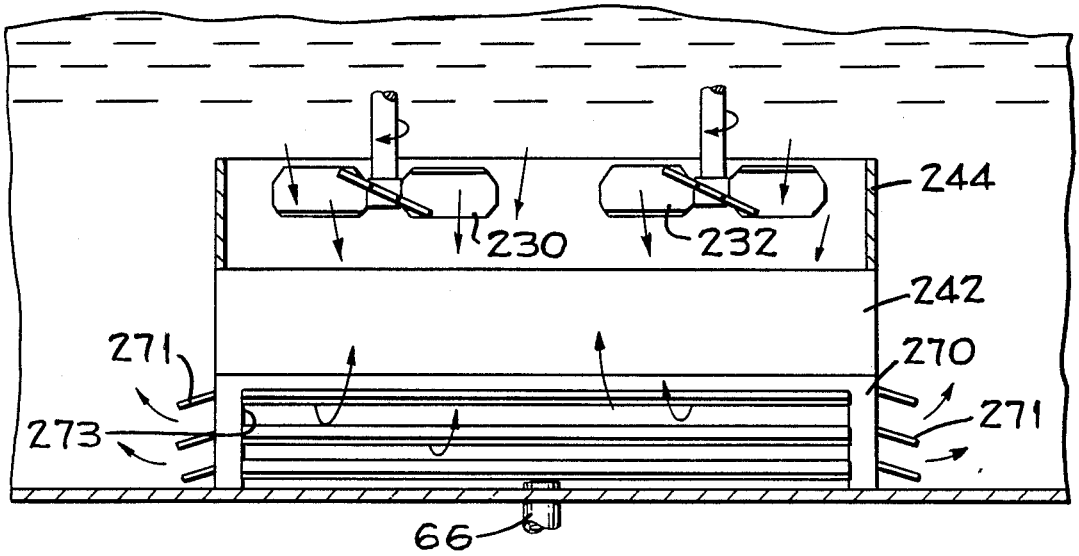
FIG. 5 is a vertical cross-sectional view, similar to FIG. 4, of still another embodiment of the present invention.

The embodiment of FIG. 5 includes a coil element 242 supported on wall members 270 on all four edges thereof. Each wall member 270 is provided with pivotable shutters 271 which can close off an opening 273 in the associated wall member. A pair of driven propellers 230 and 232 are suspended above the coil element 242 with a shroud 244 supported around the periphery of the coil element 242 to assure thorough mixing of the heated fluid with the colder bulk fluid. In the heating mode the propellers 230 and 232 are driven forcing fluid downward and causing the shutters 271 to open. Fluid will be heated as it passes downward over the coil element 242 and will mix with the colder bulk fluid as it exits through the shutters 271. During the pumping mode, the propellers will not be driven and the pump will draw fluid from the space below the coil element 242 causing the shutters 271 to close. "Last pass" heating is therefore provided for the fluid being pumped out through pipe 66 to deice an aircraft.

In both the embodiments of FIGS. 1–3 and of FIG. 5, the flappers 54 and 56 or the shutters 271 may be moved by an external force, such as a solenoid or a manually actuated Bowden cable, for example if the flappers or shutters are not opened sufficiently by the pressure differential alone. It is also contemplated that one propeller, rather than two, may suffice in all embodiments if the configuration of the coil element is amenable.

While thence embodiments of the present invention have been illustrated and described herein, various changes and modifications may be made therein without departing from the spirit of the invention as defined by the scope of the appended claims.

What is claimed is:

1. A heat exchanger for a deicer having a pump and a tank for holding deicing fluid comprising:

a coil element having an enclosed path through which a hot fluid may be circulated;

support means for supporting said coil element in said tank;

said support means forming with said tank and coil element a defined space;

stirring means supported adjacent to said coil element;

motor means for driving said stirring means to cause flow of said deicing fluid past said coil element; and a suction line connected to said pump and communicating with the interior of said space and arranged so that substantially all of the fluid flowing into said suction line when said pump is operated must flow past said coil element whereby last pass heating of the deicer fluid before being pumped to the spray gun is provided.

2. The invention according to claim 1, wherein said support means has at least one opening; and further comprising:

shutter means pivotally mounted on said support means over said opening and moveable between an open position wherein said defined space is in free communication with said tank and a closed position wherein communication with said tank is substantially only through said coil element.

3. The invention according to claim 1 and further comprising:

a baffle extending transverse to said coil member; and said stirring means causes flow of deicing fluid through said coil member into said space and from said space through said coil member from one side of said baffle to the other.

4. The invention according to claim 1, wherein said tank is formed with at least one depressed pocket and said coil member is positioned in said pocket with a passage between said pocket and said coil member; and further comprising: a flapper pivotally attached to one of said coil member and said pocket and moveable between an open position wherein said space and said passage are in free communication and a closed position wherein said passage is blocked.

5. A method of heating deicing fluid in a tank on a deicer having a coil element submerged in said tank; comprising the steps of:

a. circulating a hot fluid through said coil element;
b. heating the bulk of said deicing fluid to a predetermined holding temperature by;
   1. stirring the deicing fluid to cause free flow thereof past said coil element; and
   2. mixing the deicing fluid flowing past said coil element with the bulk of said deicing fluid;
c. raising the temperature of said deicing fluid above said holding temperature just prior to deicing an aircraft by;
   1. isolating the last portion of said deicing fluid to flow past said coil element; and
   2. pumping only said isolated portion from said tank.

6. A method of operating a deicer having a coil element submerged in a tank containing deicing fluid, and equipment for dispensing said deicing fluid onto an aircraft, comprising the steps of:

a. circulating a hot fluid through said coil element; heating the bulk of said deicing fluid to a predetermined holding temperature by;
   1. stirring the deicing fluid to cause free flow thereof past said coil element;
   2. mixing the deicing fluid flowing past said coil element with the bulk of said deicing fluid;
c. raising the temperature of said deicing fluid above said holding temperature just prior to deicing an aircraft by:
   1. isolating the last portion of said deicing fluid to flow past said coil element from the bulk of said deicing fluid;
   2. extracting only said isolated portion from said tank and
d. dispersing said extracted deicing fluid on said aircraft with said equipment.

7. In an aircraft deicer having a tank, a spray gun for directing heated deicer fluid onto an aircraft, and a deicer fluid pump connected to supply deicer fluid under pressure to said spray gun; the improvement comprising:

a heat exchanger having a coil element through which a hot fluid may be circulated;

means mounting said heat exchanger adjacent the bottom of said tank;

a suction line connected to said pump and arranged so that substantially all of the fluid flowing into said suction line when said pump is operated must flow past said coil element whereby last pass heating of the deicer fluid before being pumped to the spray gun is provided.

* * * * *